US006862420B1

(12) United States Patent
Less

(10) Patent No.: US 6,862,420 B1
(45) Date of Patent: Mar. 1, 2005

(54) TONER CONTAINER CARTRIDGE AND REFILLING APPARATUS

(75) Inventor: Krzysztof J. Less, London (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/672,573

(22) Filed: Sep. 26, 2003

(51) Int. Cl.[7] ..... G03G 15/08
(52) U.S. Cl. ..... 399/258; 399/262
(58) Field of Search ..... 399/222, 252, 399/253, 254, 255, 256, 258, 259, 260, 261, 262, 263; 222/DIG. 1; 141/67

(56) References Cited

U.S. PATENT DOCUMENTS 4,627,476 A 12/1986 Wilcke ..... 141/364
5,311,265 A 5/1994 Miller
5,895,149 A 4/1999 Weed ..... 399/262
5,953,567 A 9/1999 Muramatsu et al. ..... 399/256
6,567,635 B2 * 5/2003 Livadas et al. ..... 399/253
6,571,076 B2 * 5/2003 Kasahara et al. ..... 399/258
6,679,301 B2 * 1/2004 Makino et al. ..... 141/67

* cited by examiner

*Primary Examiner*—Hoang Ngo
(74) *Attorney, Agent, or Firm*—Tallam I. Nguti

(57) ABSTRACT

A toner container cartridge and refilling apparatus is provided for including (a) a wall defining a toner containing chamber for containing refill toner, a first end and second end; (b) a movable sealing disc closing the first end of the chamber; (c) a thin rupturable membrane sealing the second end of the chamber; (d) means for coupling the second end to a toner cartridge to be refilled with toner; and (e) a piston device for contacting and moving the sealing disk from the first end towards the second end of the chamber, thereby dispensing the refill toner from the storage chamber into the toner cartridge.

9 Claims, 3 Drawing Sheets

TONER CONTAINER CARTRIDGE AND REFILLING APPARATUS

The present invention relates to toner containers and loading systems for use with reprographic machines, and more particularly to a toner container cartridge and refilling apparatus that reduces powder clouding and minimizes toner spill during toner loading.

There are known various types of toner image producing machines including printers, facsimile machines, copiers, and the like it is well known to provide a toner hopper or cartridge within each such machine for holding a quantity of toner for use by the machine in producing toner images. This quantity of toner of course is gradually depleted by the production of toner images, and in order to keep the machine running, one approach is to refill the hopper or cartridge from a toner refill container of some sort.

Such containers need to be easy and safe to use so that one can easily replace or refill toner into the toner hopper or cartridge without spilling toner on one's self, on outer surfaces of the hopper, or on other surfaces within the toner image producing machine. Known toner refill containers typically use mechanisms such as locks or the like to attach a toner refill container onto a top surface of the toner hopper of the machine. Many have mechanisms for opening or closing apertures in the top of the toner hopper so that toner can enter the hopper.

Some known containers include a removable seal on a lower side of the container. Upon attachment of the container on top of the hopper, the seal can be removed and the toner flows down into the aperture of the hopper. However, there are problems with such current apparatus and methods. For example, there is always a risk of creating a mess when a discharge end seal must be peeled off, and toner dust clouding typically occurs when toner drops from a fixed position of the refill container discharge end into the hopper. Additionally, when such a conventional toner refill container is emptied and is being removed, cloud forming toner particles that are still dispersed within the toner hopper can escape through the aperture of the hopper and cause an unwanted mess around the hopper and inside the machine.

There is therefore a need for a toner hopper refilling apparatus for easy and safely refilling toner into a toner image production machine while also reducing toner powder clouding and minimizing toner spilling.

Thus in accordance with an aspect of the present invention, there is provided a toner container cartridge and refilling apparatus is provided for including (a) a wall defining a toner containing chamber for containing refill toner, a first end and second end; (b) a movable sealing disc closing the first end of the chamber; (c) a thin rupturable membrane sealing the second end of the chamber; (d) means for coupling the second end to a toner cartridge to be refilled with toner; and (e) a piston device for contacting and moving the sealing disk from the first end towards the second end of the chamber, thereby dispensing the refill toner from the storage chamber into the toner cartridge.

BRIEF DESCRIPTION OF THE DRAWINGS

In the detailed description of the invention below, reference is made to the drawings, in which.

DETAILED DESCRIPTION OF THE INVENTION

Figure 1:
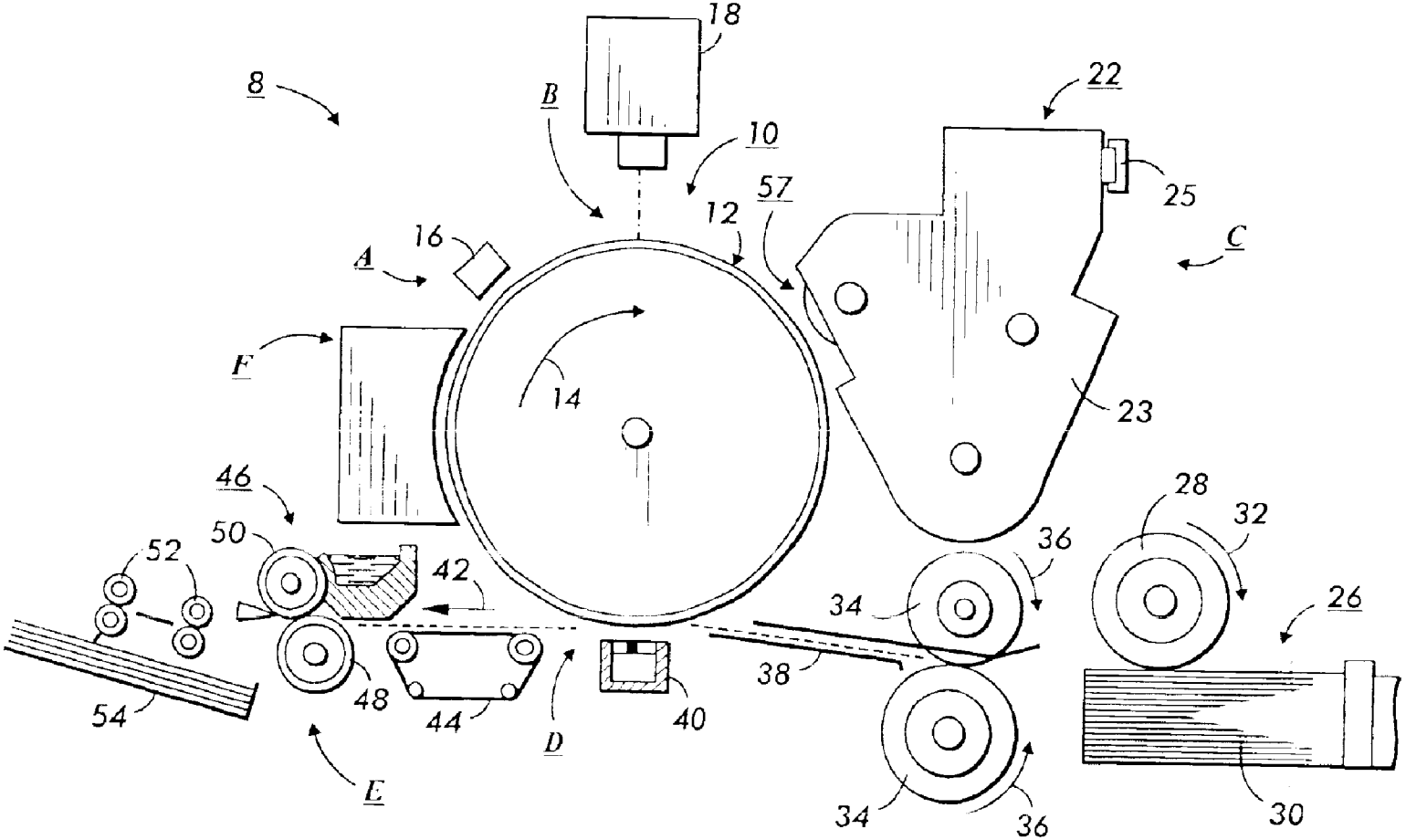
FIG. 1 is a schematic elevational view showing an illustrative toner image production machine for use with the syringe-type toner container of the present invention.

Referring first to FIG. 1, an exemplary electrostatographic reproduction machine 8 is illustrated incorporating various components, including a toner hopper 23 suitable for use with the apparatus of the present disclosure. It will become evident from the following discussion that the apparatus of the present disclosure is equally well suited for use in a wide variety of toner image producing machines not just electrostatographic reproduction machines, and is not necessarily limited in its application to the particular embodiment or method of manufacture described herein.

Inasmuch as the art of electrostatographic printing is well known, the various processing stations employed in the FIG. 1 reproduction machine will be shown hereinafter only schematically, and their operation described only briefly with reference thereto. As shown in FIG. 1, the illustrative electrostatographic reproduction machine 8 employs a drum 10 having a photoconductive surface 12 adhering to a conductive substrate. Preferably, photoconductive surface 12 comprises a selenium alloy or organic photoreceptor (OPC) with the conductive substrate being an electrically grounded aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. Exposure system 18 includes lamps that illuminate an original document positioned face down upon a transparent platen. The light rays reflected from the original document are transmitted through a lens to form a light image thereof. The light image is focused onto the charged portion of photoconductive surface 12 to selectively dissipate the charge thereon. This records an electrostatic latent image on photoconductive surface 12 that corresponds to the information in the original document.

Alternatively, exposure system 18 may be a laser-beam raster output scanner (ROS), such as used in a Laser Printer or Digital Copier. As is well known, in such a device a finely focussed laser beam is made to scan repeatedly along the length of the charged portion of drum 10 while it advances beneath the beam. The light intensity of the laser beam is electronically modulated in order to selectively dissipate the charge on drum 10 thus creating an electrostatic latent image on photoconductive surface 12 which corresponds to the information required to be printed.

As a further alternative, exposure system 18 may be an array of light emitting diodes (LEDs) that illuminate the charged portion of drum 10 while it advances beneath the LED array. The light intensity of the LEDs is electronically modulated in order to selectively dissipate the charge on drum 10 thus creating an electrostatic latent image on photoconductive surface 12 which corresponds to the information required to be printed. Thereafter, drum 10 advances the electrostatic latent image recorded on photoconductive surface 12 to development station C.

At development station C, a developer unit 22 includes a hopper 23 with a capped refill opening 25. The development unit 22 also has a magnetic roll assembly 57, which transports a developer mixture of carrier granules having toner particles adhering triboelectrically thereto into contact with the electrostatic latent image. Toner particles are attracted from the carrier granules to the latent image forming a toner powder image.

Alternatively the developer material may be of the single component type. As is well known, such a developer material does not contain carrier granules but the toner (dry ink) particles are themselves magnetic and can therefore be transported by the magnetic roll assembly 57 without the need for carrier granules. In this mode of development toner particles are attracted directly from magnetic roll assembly 57 to the electrostatic latent image on drum 10, thus forming a toner powder image on the surface of the drum 10.

After development of the electrostatic latent image, drum 10 advances the toner powder image to transfer station D. At transfer station D, a copy substrate such as a sheet of support material is moved into contact with the toner powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet into contact with photoconductive surface 12 in a timed sequence so that the toner powder image developed thereon contacts the advancing sheet at transfer station D.

Transfer station D includes a corona generating device 40 which sprays ions onto the backside of the sheet. This attracts the toner powder image from photoconductive surface 12 to the sheet. After transfer, the sheet continues to move in the direction of arrow 42 on conveyor 44 to advance to fusing station E.

Fusing station E includes a fuser assembly, indicated generally by the reference numeral 46, which permanently affixes the transferred toner powder image to the sheet. Preferably, fuser assembly 46 includes a back-up roll and a heated fuser roller 50. The sheet passes between fuser roller 50 and back-up roll with the powder image contacting fuser roller 50. In this manner, the toner powder image is permanently affixed to the sheet. After fusing, forwarding rollers 52 advance the sheet to catch tray 54 for subsequent removal from the reproduction machine by the operator.

After the powder image is transferred from photoconductive surface 12 to the copy sheet, drum 10 rotates the photoconductive surface to cleaning station F. At cleaning station F, a cleaning system, employing a magnetic roll assembly 57, for example, substantially identical to the magnetic roll assembly 57 of the developer unit 22, removes the residual particles adhering to photoconductive surface 12. The magnetic roll assembly 57 transports carrier granules closely adjacent to the photoconductive surface to attract residual toner particles thereto. In this way, the residual toner particles are removed from photoconductive surface 12.

Alternatively the cleaning station F may consist of a (stationary) elastomer cleaner blade that contacts the photoconductive surface 12. As is well known, such a cleaner-blade scrapes the toner off the surface photoconductive surface 12. The waste toner may be collected within the cleaning station F or transported out of the cleaning station F into a waste-toner container.

It is believed that the foregoing description is sufficient for purposes of the present invention to illustrate the general operation of a toner image producing machine, such as an electrostatographic reproduction machine, incorporating the features of the present invention therein.

Figure 2:
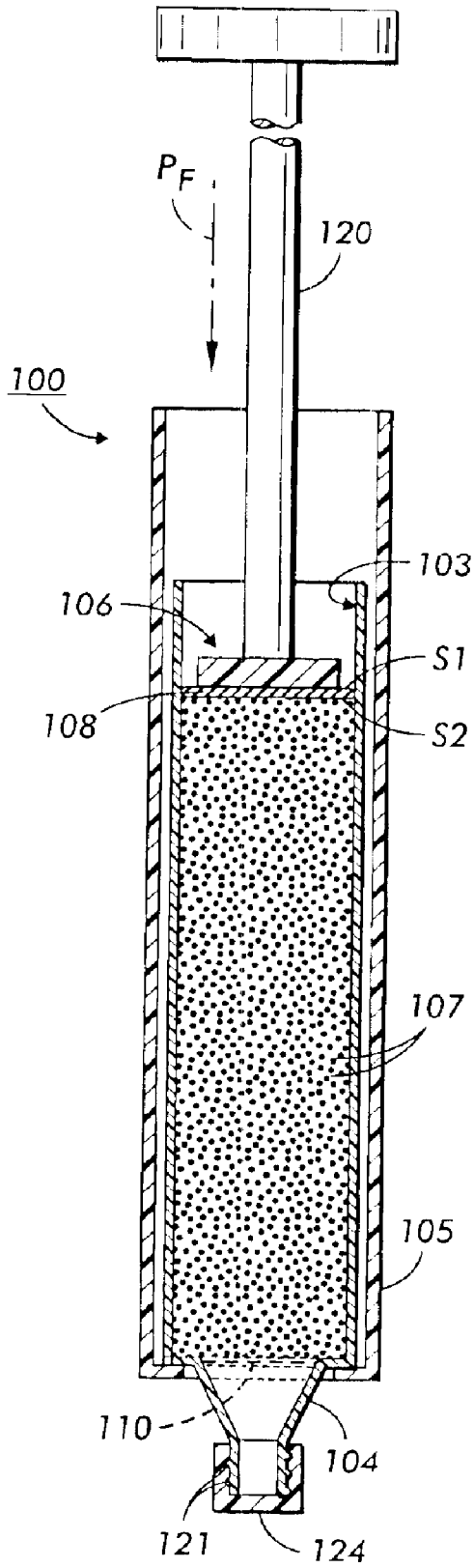
FIG. 2 is a schematic sectional illustration of a first embodiment of the syringe-type toner container of the present invention in a loaded shipping or storage mode.
Figure 3:
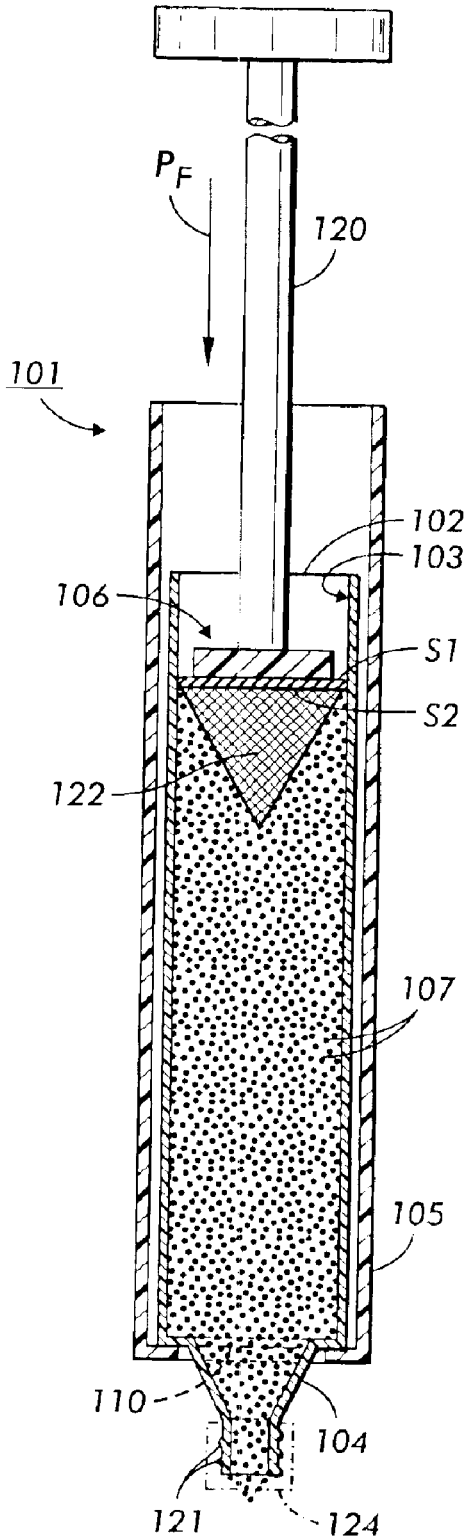
FIG. 3 is a schematic sectional illustration of the second embodiment of the syringe-type toner container of the present invention in a machine refilling mode.

Referring now to FIGS. 2–4, the present disclosure as illustrated, is directed to a syringe type toner container cartridge and refilling apparatus 100 that is suitable for use in refilling a toner hopper 23 of a toner image producing machine 8. For containing and storing toner, the cartridge and refilling apparatus 100 is sealed at a first or fill end 102 by the sliding face of the toner injecting piston 120, and at the other and opposite end 104 (that is on the end that will mate with toner hopper 23 during the machine refilling operation), by a thin membrane 110. For refilling the machine hopper 23; the cartridge and refilling apparatus 100 of the present disclosure is mated with toner hopper 23 of the machine 8 in any suitable and not necessarily vertical or near vertical orientation. Inward toner discharging pressure Pf is applied to the piston or a needle-like element 120, thereby pushing out the toner 107 and causing the thin membrane 110 to rupture. In one embodiment 101 of the cartridge and refilling apparatus 100, the inside end of the piston includes a conical ramming or spike member 122 for focusing the applied pressure. Pf and facilitating rupture of the thin membrane 110.

Rupturing of the thin membrane 110 thus allows the toner 107 within the storage chamber 106 to flow gravitationally and under the applied pressure into the toner hopper 23. When the piston 120 reaches the end of its travel, the cartridge and refilling apparatus 100 is empty, thus allowing it to be unmated or removed from the hopper 23, and the hopper 23 is resealed with the fill cap 25, while the empty cartridge and refilling apparatus 100 is discarded.

Thus in accordance with the present disclosure, there is provided a syringe type toner container cartridge and refilling apparatus 100 that includes a wall 103 defining a toner containing chamber 106 having a first end 102 and second end 104. When filled, the toner container cartridge and refilling apparatus 100 also includes refill toner 107 for subsequently adding or refilling into the hopper 23 of the toner image producing machine 8. The toner container cartridge and refilling apparatus 100 also includes a movable sealing disc 108 closing the first or fill end 102 of the chamber 106 and a thin rupturable membrane 110 sealing the second or discharge end 104 of the chamber 106. The toner container cartridge and refilling apparatus 100 includes means 105 for coupling the second end 104 to a toner hopper 23 of a machine to be refilled with toner 107. The toner container cartridge and refilling apparatus 100 further includes the piston or piston device 120 for contacting and moving the sealing disc 108 from the first end towards: the second end of the chamber, thereby dispensing the refill toner 107 from the storage chamber 106 into the toner hopper 23. The piston or piston device 120 may for example comprise an injector gun.

The sealing disc 108 has an outside surface S1 and inside surface S2 including a spike member 122 projecting into the storage chamber 106 for controlling and focusing a profile of the pressure Pf that is applied by the piston 120 to the refill toner 107 within the storage chamber 106. The spike member 122 is shaped and sized to fit snugly into a tapered inside portion of the conical second end 104 of the storage chamber for enabling effective displacing and dispensing of refill toner 107 out of such second end and into the toner hopper 23.

The thin membrane 110 is rupturable as such from the pressure Pf applied against the thin membrane 110 by refill toner 107 being pushed by the sealing disc 108 of piston 120. As shown, the toner container cartridge and refilling apparatus 100 is cylindrical in shape, and includes the conical second or discharge end 104 for mating with a toner hopper 23 of a machine 8. The second or discharge end 104 includes means such as cap threads 121 for accepting and retaining a membrane protective cap 124 during filling and storage periods. The membrane protective cap 124 is of course removed just prior to mating such second end 104 to a toner hopper 23.

The toner container cartridge and refilling apparatus 100 for example can be made of a plastic material, and the sealing disc 108 can be made of a flexible plastic material.

As can be seen, there has been provided a toner container cartridge and refilling apparatus including (a) a wall defining a toner containing chamber for containing refill toner, a first end and second end; (b) a movable sealing disc closing the first end of the chamber; (c) a thin rupturable membrane sealing the second end of the chamber; (d) means for coupling the second end to a toner cartridge to be refilled with toner; and (e) a piston device for contacting and moving the sealing disk from the first end towards the second end of the chamber, thereby dispensing the refill toner from the storage chamber into the toner cartridge.

What is claimed is:

1. A toner container cartridge and refilling apparatus for refilling a toner hopper of a toner image producing machine without toner clouding and spilling, the toner container cartridge and refilling apparatus comprising:

(a) a wall defining a toner containing chamber for containing refill toner, a first end and second end;

(b) a movable sealing disc closing said first end of said chamber;

(c) a thin rupturable membrane sealing said second end of said chamber;

(d) means for coupling said second end to a toner cartridge to be refilled with toner; and (e) a piston device for contacting and moving said sealing disk from said first end towards said second end of said chamber, thereby dispensing said refill toner from said storage chamber into said toner cartridge.

2. The toner cartridge refilling apparatus of claim 1, wherein said sealing disc has an outside surface and inside surface including a spike member projecting into said storage chamber for controlling a profile of pressure applied by said piston device to said refill toner within said storage chamber.

3. The toner container cartridge and refilling apparatus of claim 1, wherein said thin membrane is rupturable from a pressure applied against said thin membrane by refill toner being pushed by said sealing disc and piston device.

4. The toner container cartridge and refilling apparatus of claim 1, wherein said syringe type refill container is cylindrical and includes a conical second end.

5. The toner container cartridge and refilling apparatus of claim 1, wherein said syringe type container is made of a plastic material.

6. The toner container cartridge and refilling apparatus of claim 1, wherein said sealing disc is made of a flexible plastic material.

7. The toner container cartridge and refilling apparatus of claim 1, wherein said piston device comprises an injector gun.

8. The toner container cartridge and refilling apparatus of claim 1, wherein said second end of said syringe type container includes means for accepting and retaining a membrane protective cap.

9. The toner container cartridge and refilling apparatus of claim 2, wherein said spike member is shaped and sized to fit snugly into a tapered portion of said second end of said storage chamber for effectively displacing and dispensing refill toner from said second end.

* * * * *